United States Patent [19]

Capes et al.

[11] Patent Number: 4,758,332

[45] Date of Patent: Jul. 19, 1988

[54] METHOD OF SEPARATING CARBONACEOUS COAL FROM AN AQUEOUS COAL SLURRY

[75] Inventors: Charles E. Capes, Ottawa; Kevin A. Jonasson, Orleans; William L. Thayer, Ottawa, all of Canada

[73] Assignee: National Research Council of Canada, Ottawa, Canada

[21] Appl. No.: 83,355

[22] Filed: Aug. 10, 1987

[51] Int. Cl.[4] ..... B03D 1/02; B03B 7/00

[52] U.S. Cl. ..... 209/5; 209/17; 209/166; 44/51; 44/624; 44/625

[58] Field of Search ..... 209/5, 164, 166, 167, 209/17; 44/1 R, 1 SR, 624, 625

[56] References Cited

U.S. PATENT DOCUMENTS

| | | | |
|---|---|---|---|
| 3,665,066 | 5/1972 | Capes | 209/166 |
| 4,248,697 | 2/1981 | Halvorsen | 209/5 |
| 4,272,250 | 6/1981 | Burk | 209/166 |
| 4,277,252 | 7/1981 | Dudt | 209/5 |
| 4,311,488 | 1/1982 | Vershuur | 209/166 |
| 4,415,445 | 11/1983 | Van Hatten | 209/166 |
| 4,448,585 | 5/1984 | Yoo | 44/1 SR |

*Primary Examiner*—Kenneth M. Schor
*Assistant Examiner*—Thomas M. Lithgow
*Attorney, Agent, or Firm*—Francis W. Lemon

[57] ABSTRACT

In a method of agglomerating carbonaceous coal comprising first agglomerating impurity liberated carbonaceous coal, from an impurity liberated coal slurry, with agglomerating oil to form open structured, chain-like, micro-agglomerates and then forming relatively larger, less open structured more robust agglomerates from a portion of the slurry to provide a mixture of micro-agglomerates, relatively larger, more robust agglomerates, water and any inorganic impurities that may be present. The relatively larger, more robust agglomerates are screened and then the micro-agglomerates are separated using an aerating, skimmer tank leaving an inorganic impurity laden waste water. The micro-agglomerates are rendered buoyant by the aeration and are thus rendered separable from the inorganic laden waste water which may be further treated to remove the inorganic waste to provide water for recirculation.

2 Claims, 2 Drawing Sheets

METHOD OF SEPARATING CARBONACEOUS COAL FROM AN AQUEOUS COAL SLURRY

Figure 1:
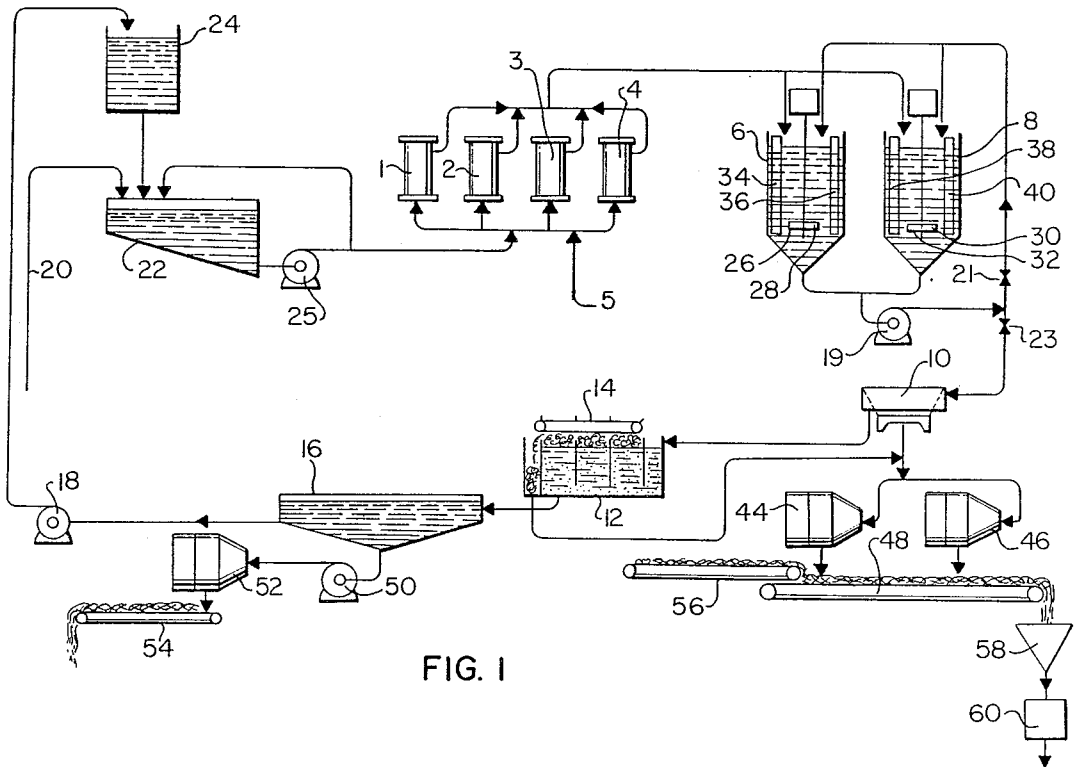

This invention relates to a method of separating carbonaceous coal from an aqueous coal slurry.

It has already been proposed in U.S. Pat. No. 3,665,066, dated May 23, 1972, "Beneficiation of Coals", C. E. Capes et al, to add a bridging liquid to an aqueous, clay containing slurry of coal fines, then agitate the resultant mixture to form coal agglomerates dispersed in a slurry of the residual clay and ash impurities, and then separate the coal agglomerates by skimming them through an overflow spout in a float-sink tank. The separation of the coal agglomerates may be assisted by introducing a multitude of air bubbles at the bottom of the float sink tank. They are then mixed with a binding oil and formed into a balled coal product in a balling device.

It has also been proposed in U.S. Pat. No. 4,284,413, dated Aug. 18, 1981, "In-Line Method For the Beneficiation of Coal and the Formation of A Coal-In-Oil Combustible Fuel Therefrom", C. E. Capes et al, to provide an in-line method for the beneficiation of coal and the formation of a coal-in-oil combustible fuel wherein the coal is wet pulverized, micro-agglomerated with light oil to dissociate a large amount of inorganic impurities and some water, agglomerated with heavy oil to form relatively larger agglomerates and dissociate mainly water with some inorganic impurities, and then mixed with further heavy oil to form the coal-in-oil combustible fuel.

While these proposals of Capes et al have proved to be useful, it has now been found that a problem exists in processes where a mixture of relatively larger, more robust, carbonaceous coal agglomerates and weaker agglomerates are formed from micro-agglomerated carbonaceous coal.

When carbonaceous coal is separated from inorganic impurities by micro-agglomeration followed by the formation of a portion of relatively larger, more robust agglomerates, a portion of the carbonaceous coal in the form of difficult-to-isolate relatively weaker micro-agglomerates often remains in the separated water which also contains inorganic impurities. The proportion of micro-agglomerates which remain in the separated water and inorganics may be dependent upon whether the amount of oil added for agglomeration is sufficient, whether the mixing is optimal or whether the carbonaceous coal is relatively more difficult to agglomerate, such as, for example, when the coal is a low rank or oxidized coal.

There is a need for a process wherein micro-agglomerates may be separated when present in water and inorganic impurities together with relatively larger, more robust agglomerates.

According to the present invention there is provided a method of separating carbonaceous coal from an aqueous coal slurry, comprising (a) mixing an agglomerating oil for carbonaceous coal with an aqueous coal, impurity liberated coal slurry, comprising particles of carbonaceous coal, particles of inorganic impurities, and water, until open structured, chain-like micro-agglomerates are formed from carbonaceous coal particles of the slurry, then (b) mixing the slurry containing the micro-agglomerates under conditions sufficient to form relatively larger, less open structured, more robust agglomerates from a portion of the micro-agglomerates to provide a slurry containing micro-agglomerates and relatively larger agglomerates, then (c) separating the relatively larger, more robust agglomerates from the slurry to leave a mixture of water, micro-agglomerates of carbonaceous coal particles and particles of inorganic impurities, and then (d) aerating the slurry to render the micro-agglomerates of carbonaceous coal particles buoyant, and then (e) separating buoyant micro-agglomerates of carbonaceous coal particles from a major portion of the water and the particles of inorganic impurities.

In some embodiments of the present invention, after removal of micro-agglomerates, the water fraction is separated from the inorganic impurities therein and is recirculated as feed water for the aqueous coal slurry.

In other embodiments of the present invention, the micro-agglomerates are formed in a relatively high shear, impeller blade mixer, the relatively larger, more robust agglomerates are formed in a relatively low shear, impeller blade mixer, and a portion of the water containing relatively larger, more robust agglomerates from the relatively low shear, impeller blade mixer is recirculated for further mixing therein to enhance nucleation of the relatively larger, more robust agglomerates.

The carbonaceous fine coal product which comprises the micro-agglomerates may be mixed with relatively coarser grain, clean coal for ease of transportation, storage and utilization.

Figure 2:
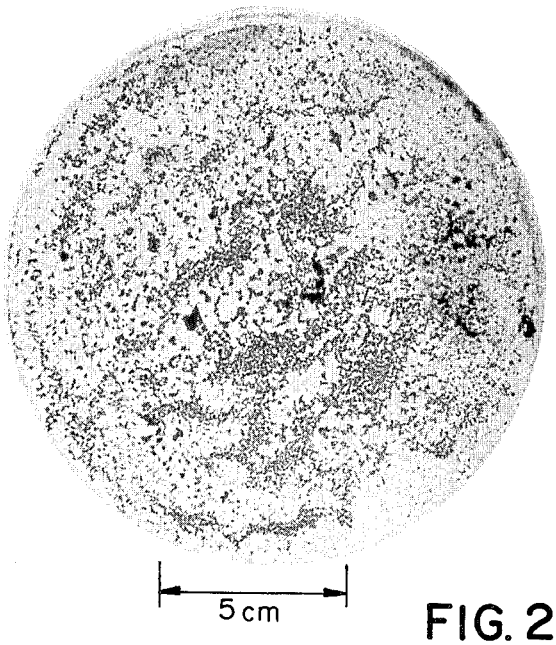
Figure 3:
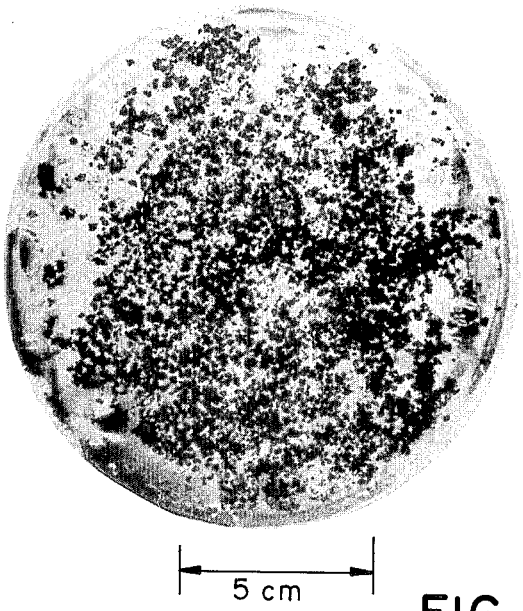

Alternatively, the carbonaceous fine coal product which comprises the micro-agglomerates and the relatively larger, more robust agglomerates, may be mixed together with a binder therefor for size enlargement of the agglomerates for increased flowability during transporation, storage and utilization. In the accompanying drawings which illustrate, by way of example, embodiments of the present invention, FIG. 1 is a flow diagram of a method of separating carbonaceous coal from an aqueous coal slurry, FIG. 2 is a photograph of open structured, chain-like micro-agglomerates obtained from tests using the apparatus described with reference to the flow diagram shown in FIG. 1, and FIG. 3 is a photograph of relatively larger, less open structured, more robust agglomerates obtained during the tests. In FIG. 1 there is shown a method of separating carbonaceous coal from an aqueous coal slurry, comprising (a) mixing, in relatively high shear, impeller blade mixers 1 to 4, an agglomerating oil for carbonaceous coal with an aqueous, impurity liberated, coal slurry until open structured, chain-like micro-agglomerates are formed from carbonaceous coal particles of the slurry, (b) mixing in relatively low shear impeller blade mixers 6 and 8, the slurry containing the micro-agglomerates to form relatively larger, less open structured, more robust agglomerates from a portion of the micro-agglomerates to provide a slurry containing micro-agglomerates and relatively larger agglomerates, (c) separating by size in a screening device 10, the relatively larger agglomerates from the slurry, (d) aerating the slurry in a skimmer tank 12, to render the micro-agglomerates buoyant, and (e) separating, by means of a skimmer belt-paddle system 14, buoyant micro-agglomerates from a major portion of the water and any inorganic impurities of the slurry.

After removal of the micro-agglomerates, the water is separated from inorganic impurities in a settling tank 16 and is recirculated by pump 18 as feed water for the aqueous coal slurry.

A portion of the water containing the relatively larger, more robust agglomerates and exiting from the relatively low shear, impeller blade mixers 6 and 8 is recirculated, by means of a pump 19 and adjustment of valves 21 and 23, for further mixing therein.

More particularly, a coal slurry feed from, for example, a fine waste stream of a coal cleaning plant (not shown) is fed along a feed pipe 20 to a dilution tank where the water content is adjusted with make up water from a header tank 24. The coal slurry is then pumped by a pump 25 to the high shear, impeller blade mixers 1 to 4. The agglomerating oil is fed by feed pipe 5 into the coal slurry being pumped to the high shear, impeller blade mixers 1 to 4. The agglomerating oil is fed by feed pipe 5 into the coal slurry being pumped to the high shear, impeller blade mixers 1 to 4.

The relatively high shear, impeller blade mixers 1 to 4 are preferably of the type described and claimed in U.S. Pat. No. 4,610,547, dated Sept. 9, 1986, "Apparatus For Dispersing A Particulate Material In A Liquid", Bennett et al, wherein, as shown in that patent, the slurry passes upwardly through a cylindrical container past a lower, flat impeller blade type turbine rotor, an intermediate knife impeller blade type turbine rotor and an upper pitched impeller blade type turbine rotor. As previously stated, micro-agglomerates of impurity liberated carbonaceous coal particles are agglomerated from the coal slurry in the relatively high shear, impeller blade mixers 1 to 4, wherein high intensity mixing, distributing and dispersion of the agglomerating oil with the carbonaceous particles of the slurry occurs.

The micro-agglomerates, water and any inorganic impurities originally present in the coal slurry are passed to the relatively low shear, impeller blade mixers 6 and 8 each having four, radial flow, flat impeller blades, two of which are shown and designated 26, 28 and 30 and 31, respectively. The relatively low shear, impeller blade mixers 6 and 8 are provided with four baffles, two of which are shown for each mixer 6 and 8 and designated 34, 36 and 38, 40, reduce any flow around the impeller blade shaft, caused by the flat impeller blades such as those designated 26, 28 and 30 and 32, of the micro-agglomerates, water and any inorganic impurities present so that the predominant flow is radially outwardly from the impeller blades such as those designated 26, 28 and 30, and 32, and then inwardly rebounding along curved paths over and under the impeller blades, such as those designated 26, 28 and 30 and 32, generally towards a central point between them. The baffles such as those designated 34, 36 and 38 and 40 are spaced from the containers in which they are situated to avoid the formation of stagnant areas between the baffles, such as those designated 34, 36 and 38 and 40 and their respective containers.

As previously stated, a portion of the slurry containing larger, more robust agglomerates from the relatively low shear, impeller blade mixers 6 and 8 is recirculated, by means of pump 19, for further mixing therein.

By optimizing, for the particular coal being treated, the carbonaceous coal particle size, the amount of oil used and, the recirculation amount, (i) the escape of carbonaceous coal through the relatively low shear, impeller blade mixers 6 and 8 in discrete particle form, that is carbonaceous coal particles which have not been agglomerated, is minimized, and (ii) the ratio of micro-agglomerates to relatively larger, more robust agglomerates in the discharge from the relatively low shear, impeller blade mixers 6 and 8 can be optimized.

The desired ratio of recirculation of the discharge from the relatively low shear, impeller blade mixers 6 and 8, is to a large extent dependent upon the amount of agglomerating oil that is used.

There are a number of factors involved which determine whether there is a predominance of relatively larger, more robust agglomerates formed from the slurry, or a predominance of micro-agglomerates formed therein. Among these factors are whether or not the carbonaceous coal is oxidized, whether the coal is a low rank coal or a bituminous coal and the residence times in the mixers 6 and 8. However, it is important to note that:

(a) a predominance of the relatively larger, more robust agglomerates is obtained when, for example, (i) the ash release particle size of the carbonaceous coal being treated is large enough for a relatively low agglomerating oil content to be used to produce the relatively larger, more robust agglomerates, or (ii) the coal slurry being treated is a tailings containing sufficiently low agglomerating oil content to be used to produce the relatively larger, more robust agglomerates, and (b) a predominance of micro-agglomerates is obtained when, for example, a minimal agglomerating oil content is used.

The pump 19 also provides some relatively low shear mixing for agglomerating carbonaceous coal particles that have not been agglomerated in the relatively low shear, impeller blade mixers 6 and 8.

The dewatered, relatively larger, more robust agglomerates from the screening device 10 are passed to two screen bowl type centrifugal separators 44 and 46 which further dewater them and pass them to a clean coal conveyor 48 which conveys them for storage or further treatment into a fuel.

The micro-agglomerates from the skimmer tank 12 are passed to the screen bowl type centrifugal separators 44 and 46 for dewatering with the relafively larger, more robust agglomerates and eventual deposition therewith on the clean coal conveyor 48.

As previously stated, the clean water from the settling tank 16 is pumped by pump 18 for recirculation. Inorganic impurities, such as ash, which have settled out of the water in the settling tank 16 are pumped by a pump 50 to a dewatering device 52 where the dewatered inorganic impurities are passed to a conveyor belt 54 for disposal.

In tests to verify the present invention, (i) the relatively high shear impeller blade mixers 1 to 4 each had a 600 liter mixing capacity and a 55 KW mixer, (ii) the relatively low shear impeller blade mixers 6 and 8 each had a 12,000 liter mixing capacity and a 7.5 KW mixer, (iii) the pump 19 and the valves 21 and 23 recirculated 6,000 to 12,000 liters/minute of water containing the relatively larger, more robust agglomerates to the relatively low shear impeller blade mixers 6 and 8, (iv) the classification cut of the screening device 10 was 60–100 mesh, (v) the screen bowl type centrifugal separators 44 and 46 each had about 20 metric tonnes/hour capacity, (vi) the dewatering device 52 was a solid bowl centrifuge having a capacity of about 10 metric tonnes/-hour capacity, (vii) the aqueous coal slurry fed by the pump 25 to the relatively high shear impeller blade mixers 1 to 4 contained 15 wt % solids of which 30 wt % was ash.

In a first set of the tests, 2,600 litres/minute of the aqueous coal slurry containing about 5 wt % agglomerating oil based on the total solids content of the aqueous coal slurry was fed by the pump 25 to the relatively high shear impeller blade mixers 1 to 4.

The screening device 10 captured 80 wt % of the agglomerates formed leaving 20 wt % to be captured by the skimmer belt 14 from the skimmer tank 12, The screen bowl type centrifuge separators 44 and 46 delivered relatively larger, more robust agglomerates containing 17.5 wt % moisture and 10.7 wt % ash, together with 4.8 wt % agglomerating oil, to the conveyor 48.

The solid bowl centrifuge 52 produced a refuse product containing 28.9 wt % moisture and 69 wt % ash (dry basis) from the feed thereto, for deposition on the conveyor belt 54.

In a second set of tests, 3,200 liters/minute of the aqueous coal slurry containing about 8 wt % agglomerating oil (based on the total solids content of the aqueous coal slurry) was fed by the pump 25 to the relatively high shear impeller blade mixers 1 to 4.

This second set of tests produced a greater preponderance of the relatively larger, more robust agglomerates than the first set of tests with the consequence that 95 wt % of the agglomerates formed were captured on the screening device 10 leaving 5 wt % to be captured by the skimmer belt 14 from the skimmer tank 12.

The screen bowl type centrifugal separators 44 and 46 delivered relatively larger, more robust agglomerates containing 15 wt % moisture and 10 wt % ash to the conveyor 48.

The solid bowl centrifuge 52 produced a refuse product containing 35 wt % moisture and 79 wt % ash (dry basis) from feed thereto, for deposition on the conveyor belt 54.

FIG. 2 is a photograph of typical open structured, chain-like micro-agglomerates that are produced in the slurry of the relatively high shear, impeller blade mixers 1 to 4. It is clear from FIG. 2 that these micro-agglomerates are relatively weaker and consequently are difficult to separate from water and any impurities present.

FIG. 3 is a photograph of a typical slurry produced by the relatively low shear impeller blade mixers 6 and 8 and containing relatively larger, more robust agglomerates. It is clear from FIG. 3 that these relatively larger, more robust agglomerates can be separated from the slurry, while any open structured, chain-like micro-agglomerates present in the slurry will to a large extent be lost in the water and inorganics separated from the relatively larger, more robust agglomerates.

In different embodiments of the present invention, the slurry containing the micro-agglomerates and the relatively larger, more robust agglomerates is passed directly from the relatively low shear, impeller blade mixers 6 and 8, by the pump 19, to the skimmer tank 12, where all of the agglomerates are aerated and separated by means of the skimmer belt 14 in one operation.

In other embodiments of the present invention, relatively coarse grain, clean coal, from, for example, the coal cleaning plant (not shown) from which the coal slurry feed along feed pipe 20 is derived, is fed along a conveyor 56 to the conveyor 48. The conveyor 48 then conveys the relatively coarser coal, the dewatered micro-agglomerates and the dewatered relatively larger, more robust agglomerates to a hopper 58, which passes them to a mixer 60 where all of them are mixed for use, for example, as a combustible fuel, for carbonization or for making a coal liquid fuel.

In yet other embodiments of the present invention, when only micro-agglomerates and the relatively larger, more robust agglomerates are fed to the hopper 58, the mixer 60 may be used to add a binder such as, for example, asphaltic oil, bitumen, coke oven tar or a polymeric emulsion for size enlargement of the agglomerates for increased flowability.

In yet other embodiments, where the type of coal or agglomerating oil or both permit it, the formation from the original slurry of a slurry containing a mixture of agglomerates may be carried out in the same mixer or the same group of mixers in parallel.

Further tests were carried out, adding a frothing agent to improve recovery of the micro-agglomerates by the skimmer belt paddle system 14. The frothing agent used was that marketed under the trademark "Aerofroth" by Cyanamid, Montreal, Canada. The amount of frothing agent added was up to about 0.5 kilograms/metric ton of feed to the skimmer tank 12.

These tests showed an improvement in recovery, and a more reproduceable higher recovery, of micro-agglomerates than was obtainable when no frothing agent was used.

It is within the scope of the present invention to use other conditioning agents than frothing agents to enhance the performance of the method for the separation the carbonaceous coal from the aqueous slurry.

For example, long chain alcohols such as that marketed under the trademark 'ACCOAL' by Cyanamid, Montreal, Canada, may be used, or any other surface active agent for the carbonaceous coal may be used which will, for example, enhance the wettability of the carbonaceous coal by the agglomerating oil.

The present invention has been found to be useful for separating carbonaceous coal from low rank, oxidized coals and bituminous coals.

We claim:

1. A method of separating carbonaceous coal from an aqueous coal slurry, comprising (a) mixing an agglomerating oil for carbonaceous coal with an aqueous, impurity liberated, coal slurry, comprising particles of carbonaceous coal, particles of inorganic impurities, and water, until open structured, chain-like micro-agglomerates are formed from carbonaceous coal particles of the slurry, then (b) mixing the slurry containing the micro-agglomerates under conditions sufficient to form relatively larger, less open structured, more robust agglomerates from a portion of the micro-agglomerates to provide a slurry containing micro-agglomerates and relatively larger agglomerates, then (c) separating the relatively larger, more robust agglomerates from the slurry to leave a mixture of water, micro-agglomerates of carbonaceous coal particles and particles of inorganic impurities, then (d) aerating the water containing the micro-agglomerates of carbonaceous coal particles and particles of inorgainic impurities to render the micro-agglomerates of carbonaceous coal particles buoyant, and then (e) separating buoyant micro-agglomerates of carbonaceous coal particles from a major portion of the water and the particles of inorganic impurities, and then (f) mixing the separated micro-agglomerates with the separated relatively larger robust agglomerates to form a combined microagglomerate, robust agglomerate product.

2. A method according to claim 1, wherein the combined micro-agglomerate, robust agglomerate product is further mixed with a relatively coarser grain clean coal to form a combustible fuel.

* * * * *